US007536828B2

(12) United States Patent
Slingerland et al.

(10) Patent No.: US 7,536,828 B2
(45) Date of Patent: May 26, 2009

(54) FLOWER BOX ASSEMBLY

(75) Inventors: Johannes Theodorus Maria Slingerland, Voorhout (NL); Antonius Johanna Maria Loverbos, Asten (NL); Hendricus Bernardus Johannes Lamboo, Noordwijk (NL); Bernardus Johannes Leonardus Lamboo, Noordwijk (NL)

(73) Assignee: Flitsco B.V., De Kwakel (NL)

( * ) Notice: Subject to any disclaimer, the term of this patent is extended or adjusted under 35 U.S.C. 154(b) by 115 days.

(21) Appl. No.: 10/806,070

(22) Filed: Mar. 22, 2004

(65) Prior Publication Data

US 2004/0238396 A1 Dec. 2, 2004

(30) Foreign Application Priority Data

Mar. 20, 2003 (NL) ..... 1022981
Sep. 12, 2003 (NL) ..... 1024283

(51) Int. Cl.
*B65D 85/50* (2006.01)

(52) U.S. Cl. ..... 47/65; 47/39; 47/41.01

(58) Field of Classification Search ..... 47/41.01, 47/65, 66.6, 75, 39, 84, 65.5, 29.6, 86; 206/499, 206/423, 503–513, 515, DIG. 821
See application file for complete search history.

(56) References Cited

U.S. PATENT DOCUMENTS

| | | | | |
|---|---|---|---|---|
| 3,759,415 | A | | 9/1973 | Cloyd |
| 4,291,493 | A | | 9/1981 | Monson |
| 4,432,161 | A | | 2/1984 | De Bruin |
| 5,042,674 | A | * | 8/1991 | Ramsay et al. ..... 220/4.24 |

FOREIGN PATENT DOCUMENTS

| | | | |
|---|---|---|---|
| EP | 1 306 319 A2 | | 5/2003 |
| JP | 1-108926 | * | 4/1989 |
| JP | 2002-326630 | * | 11/2002 |
| JP | 2003-170981 | * | 6/2003 |
| NL | 1 019 223 C | | 5/2003 |

* cited by examiner

*Primary Examiner*—Trinh T. Nguyen
(74) *Attorney, Agent, or Firm*—Weingarten, Schurgin, Gagnebin & Lebovici LLP

(57) ABSTRACT

A flower box assembly comprising an inner box and an inner box holder, the inner box having a bottom wall and at least one closed sidewall, such that it is at least partly fillable with water, the inner box holder having at least one sidewall and an open lower side and upper side, the inner box being provided with means with the aid of which the inner box is detachably connectible with the inner box holder, while, preferably, the inner box holder and the inner box are so designed that onto an assembly of an inner box holder and an inner box, a second inner box holder is placeable in inverted position, the downwardly directed upper side of the second inner box holder engaging an upper side of the inner box, or the upper side of the first inner box holder.

31 Claims, 12 Drawing Sheets

FLOWER BOX ASSEMBLY

This application claims priority to Dutch application No. NL 1022981 filed Mar. 20, 2003, and to Dutch application No. NL 1024283 filed Sep. 12, 2003.

BACKGROUND OF THE INVENTION

The invention relates to a flower box assembly. Such flower box assemblies are intended in particular for use at auctions or the like and serve for the storage and the transport of cut flowers.

BRIEF SUMMARY OF THE INVENTION

The invention provides a flower box assembly comprising an inner box and first inner box holder, the inner box having a bottom wall and at least one closed sidewall, such that it is at least partly fillable with water, the first inner box holder having at least one sidewall and an open lower side and upper side, the inner box being provided with means with the aid of which the inner box is detachably connectible with the inner box holder.

Such an assembly which is preferably manufactured entirely from plastic can be made of particularly stable design. Owing to the inner box and the inner box holder being detachably connectible with each other, the inner boxes and the inner box holders can be stored separately from each other, for instance by nested stacking of the inner boxes within each other and nested stacking of the inner box holders within each other.

According to a further elaboration of the invention, the assembly is provided with a second inner box holder, wherein the inner box is placed in the second inner box holder, wherein the second inner box holder is subsequently pulled up alongside the inner box, wherein the assembly thus formed is placed on the first inner box holder, such that the second inner box holder rests on an upper side of the first inner box holder.

The first inner box holder can form a stable holder for an inner box, so that falling over of the inner box is prevented by the stable inner box holder. Also, the first inner box holder can form a stable support for an assembly of an inner box and a second inner box holder. Then, the second inner box holder can constitute a protection for the cut flowers projecting above the upper side of the inner box.

According to a further elaboration of the invention, the first inner box holder can differ from the second inner box holder. However, it is also possible that the first and second inner box holder are configured in the same way.

According to a further elaboration of the invention, onto the second inner box holder, a first inner box holder is placeable.

The second inner box holder then not only protects the cut flowers projecting above the upper side of the inner box, but additionally serves as a support for a second assembly of an inner box and an inner box holder. Accordingly, in this way, cut flower-filled assemblies of inner boxes with inner box holders can be stacked onto each other. This yields a considerable saving a space. Moreover, it is particularly favorable that this stacking possibility does not require any additional parts. This additional functionality is obtained with the inner box and inner box holder which are necessary anyway.

According to a further elaboration of the invention, it is preferred that the sidewalls of the inner box holders, viewed from the bottom, taper slightly towards each other in the direction of the upper side, such that the inner box holders are mutually nestable. The result is that the inner box holder sits on the ground with a large base and thus provides a stable arrangement. As regards the inner boxes, too, according to a further elaboration, the sidewalls thereof, viewed from an upper side, taper slightly towards each other in the direction of the bottom wall, such that the inner boxes are mutually nestable. Thus, both the inner boxes and the inner box holders can be stored in a nested stack occupying little space.

Further, according to a further elaboration of the invention, it is favorable when in the at least one sidewall of the inner box holders, at least one light passage opening is included. What is accomplished in this way is that the cut flowers in the lower assemblies of a stack of cut flower-filled flower box assemblies are still illuminated and aerated in a natural way.

The invention also provides a method for handling a flower box assembly according to the invention, wherein an inner box is placed in a second inner box holder, wherein subsequently the second inner box holder is pulled up alongside the inner box, and is subsequently placed with the inner box on a first inner box holder, such that the inner box extends substantially within the contours of the first inner box holder and that the second inner box holder protects the content of the inner box.

According to a further elaboration of the method according to the invention, at a suitable moment—for example before or after the second inner box holder is pulled up—the inner box can be filled with flowers.

In a thus formed assembly the content of the inner box is protected by the second inner box holder. Besides, the second inner box holder can serve as an aid for carrying the inner box by hand. Particularly when the second inner box holder is provided with handgrips, the assembly of an inner box and an inner box holder can be readily held by the handgrips.

Further elaborations of the invention are described in the subclaims and will be further clarified hereinafter on the basis of a number of exemplary embodiments with reference to the drawing.

DETAILED DESCRIPTION OF THE INVENTION

Figure 1:
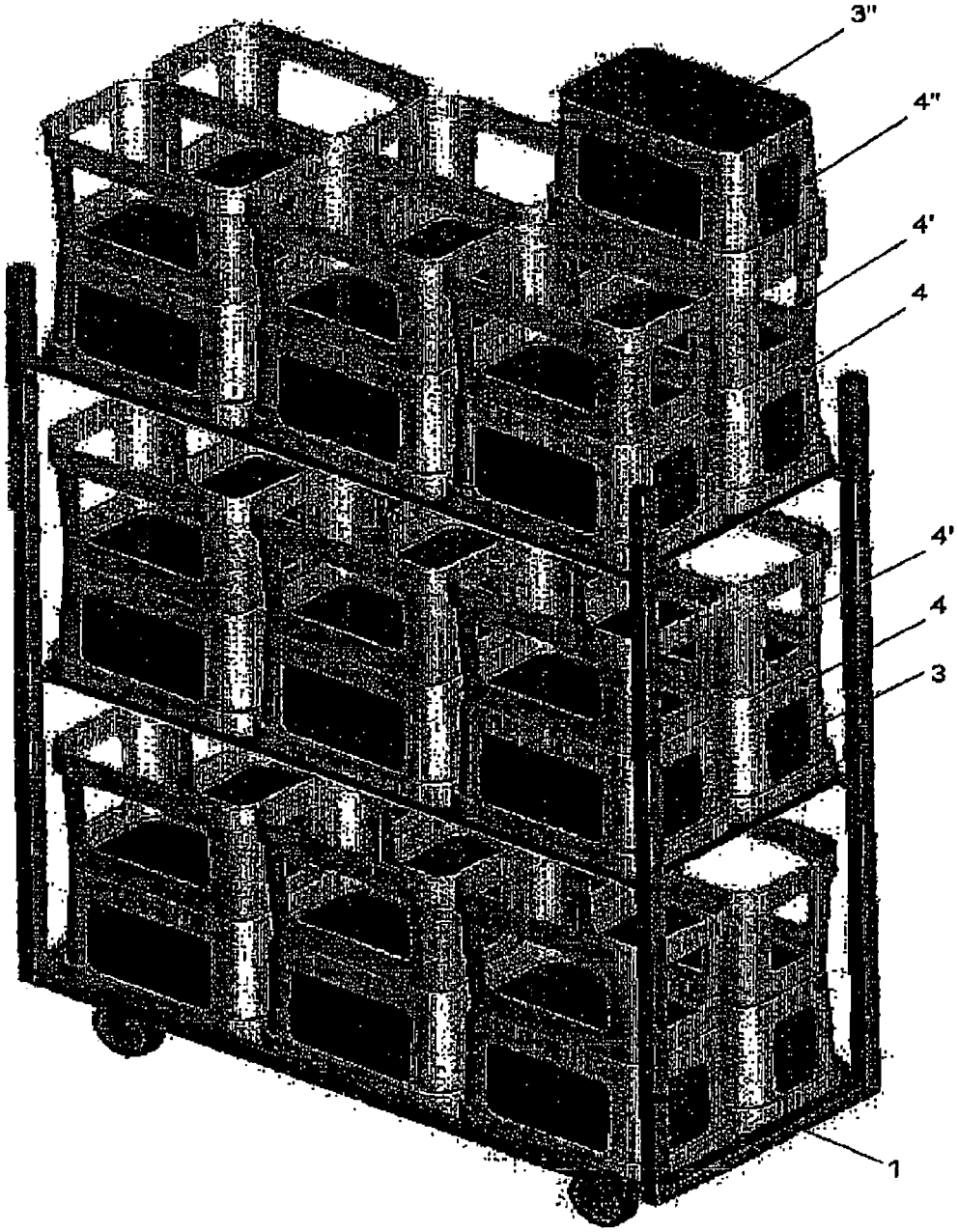
FIG. 1 shows a perspective view of an embodiment of a number of flower box assemblies placed on a dolly.
Figure 2:
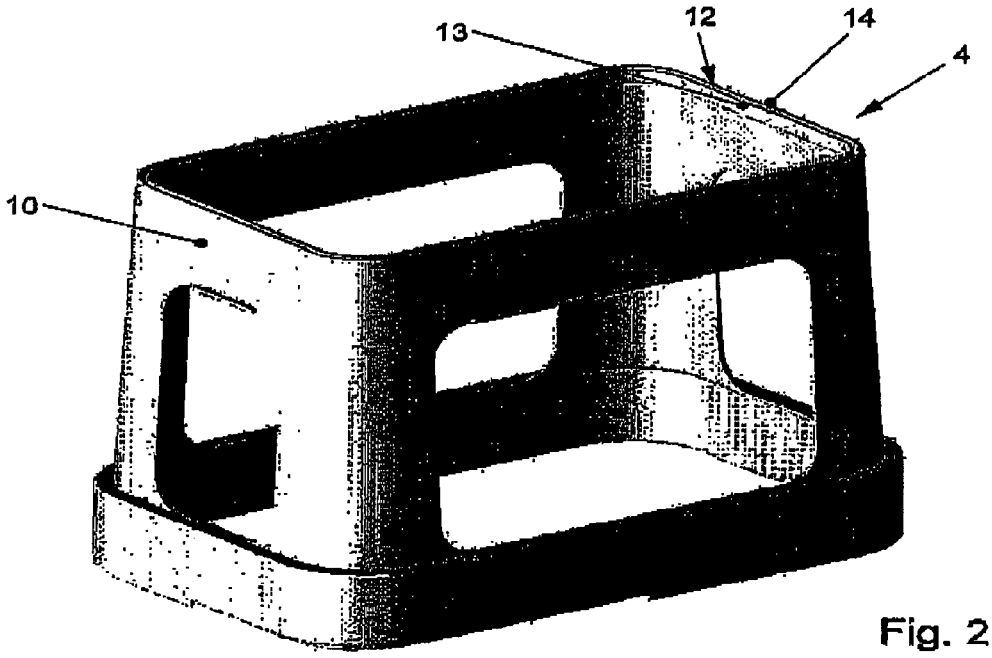
FIG. 2 shows a perspective top plan view of an inner box holder according to a first exemplary embodiment of the invention.
Figure 3:
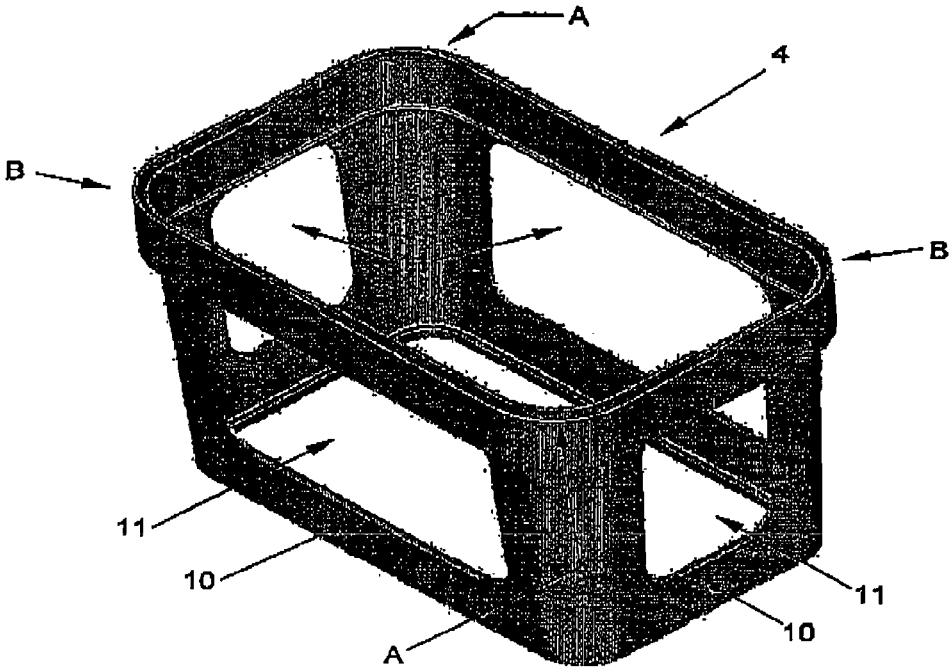
FIG. 3 shows a perspective bottom plan view of the inner box holder shown in FIG. 2.
Figure 4:
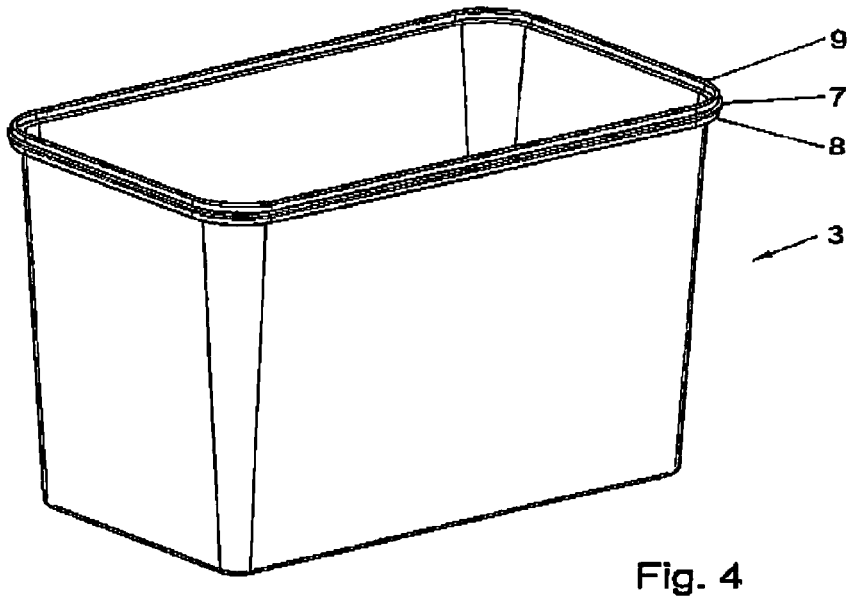
FIG. 4 shows a perspective top plan view of an inner box of the first exemplary embodiment.
Figure 5:
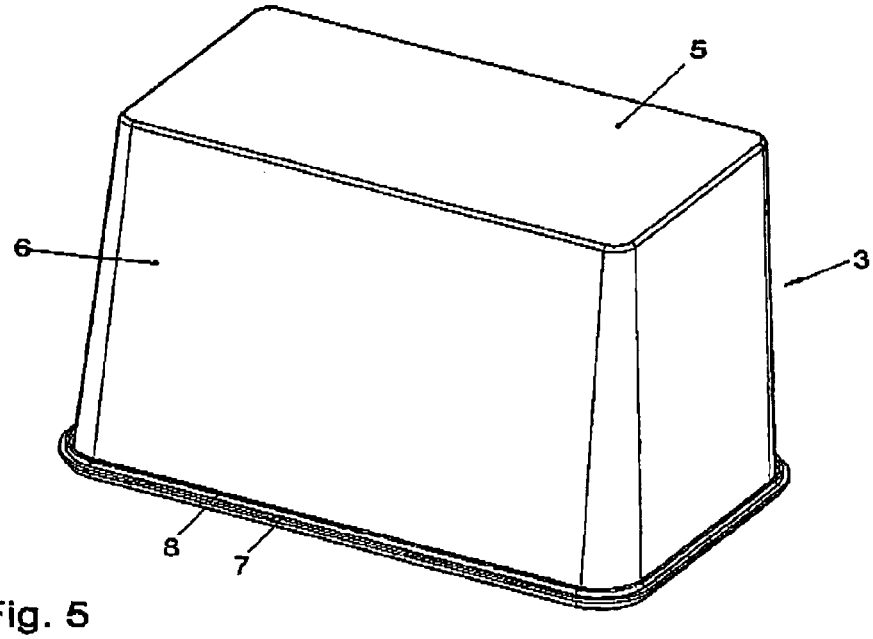
FIG. 5 shows a perspective bottom plan view of the inner box shown in FIG. 4.
Figure 6:
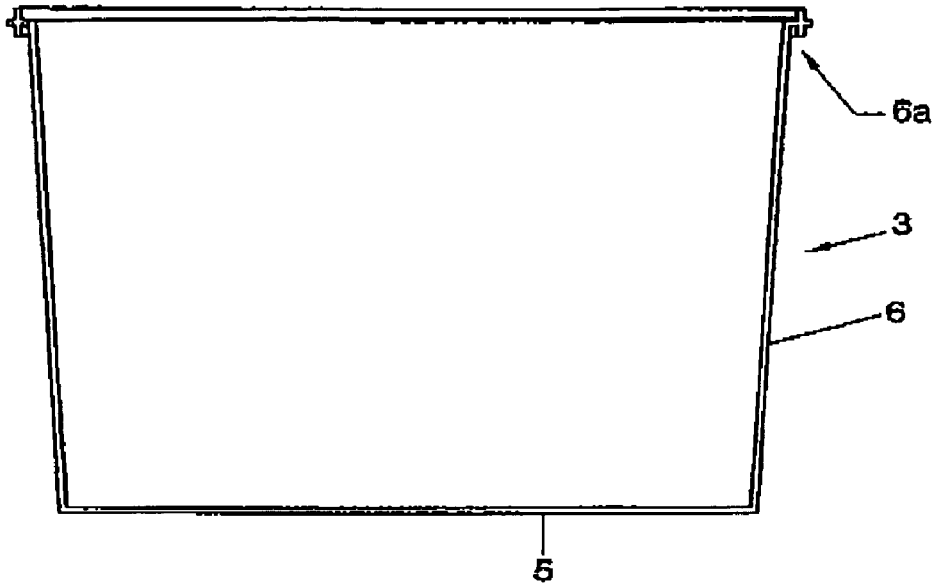
FIG. 6 shows a vertical longitudinal cross section of the inner box shown in FIG. 4.
Figure 7:
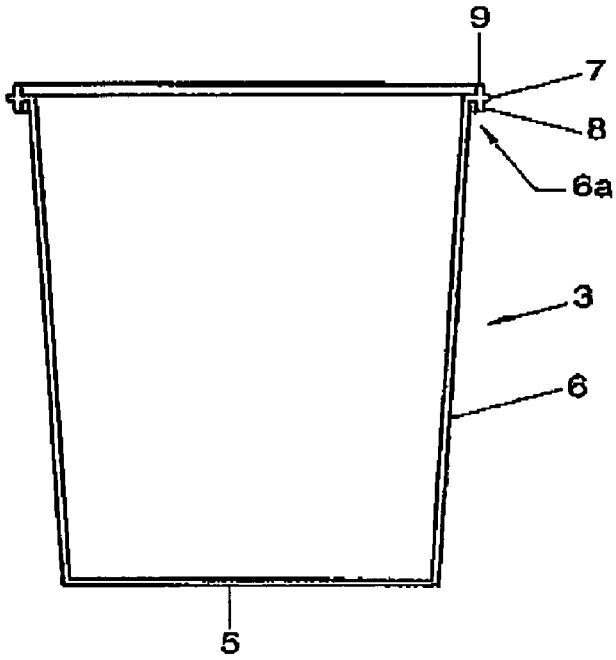
FIG. 7 shows a vertical transverse cross section of the inner box shown in FIG. 4.
Figure 8:
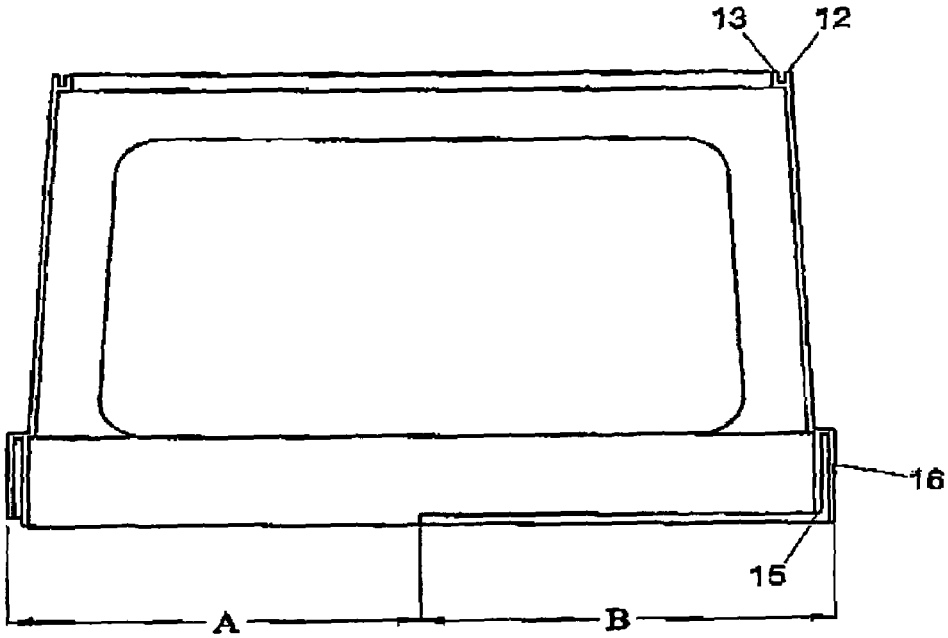
FIG. 8 shows a vertical longitudinal cross section of the inner box holder shown in FIG. 2.
Figure 9:
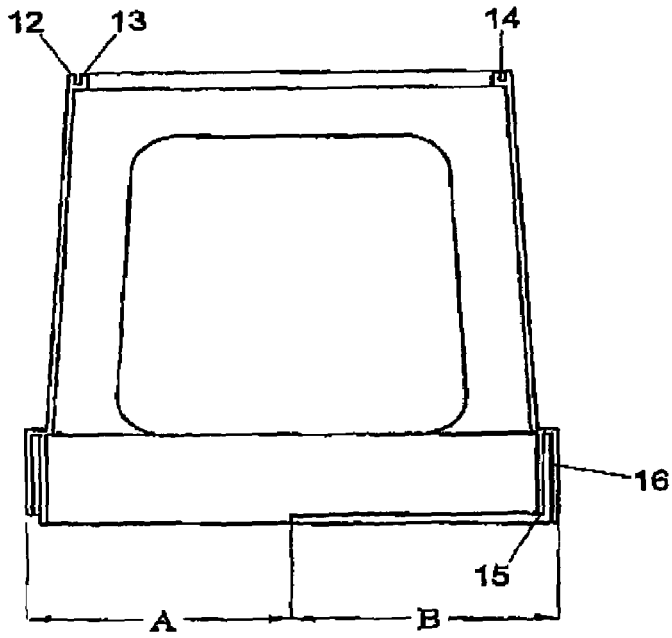
FIG. 9 shows a vertical transverse cross section of the inner box holder shown in FIG. 2.
Figure 10:
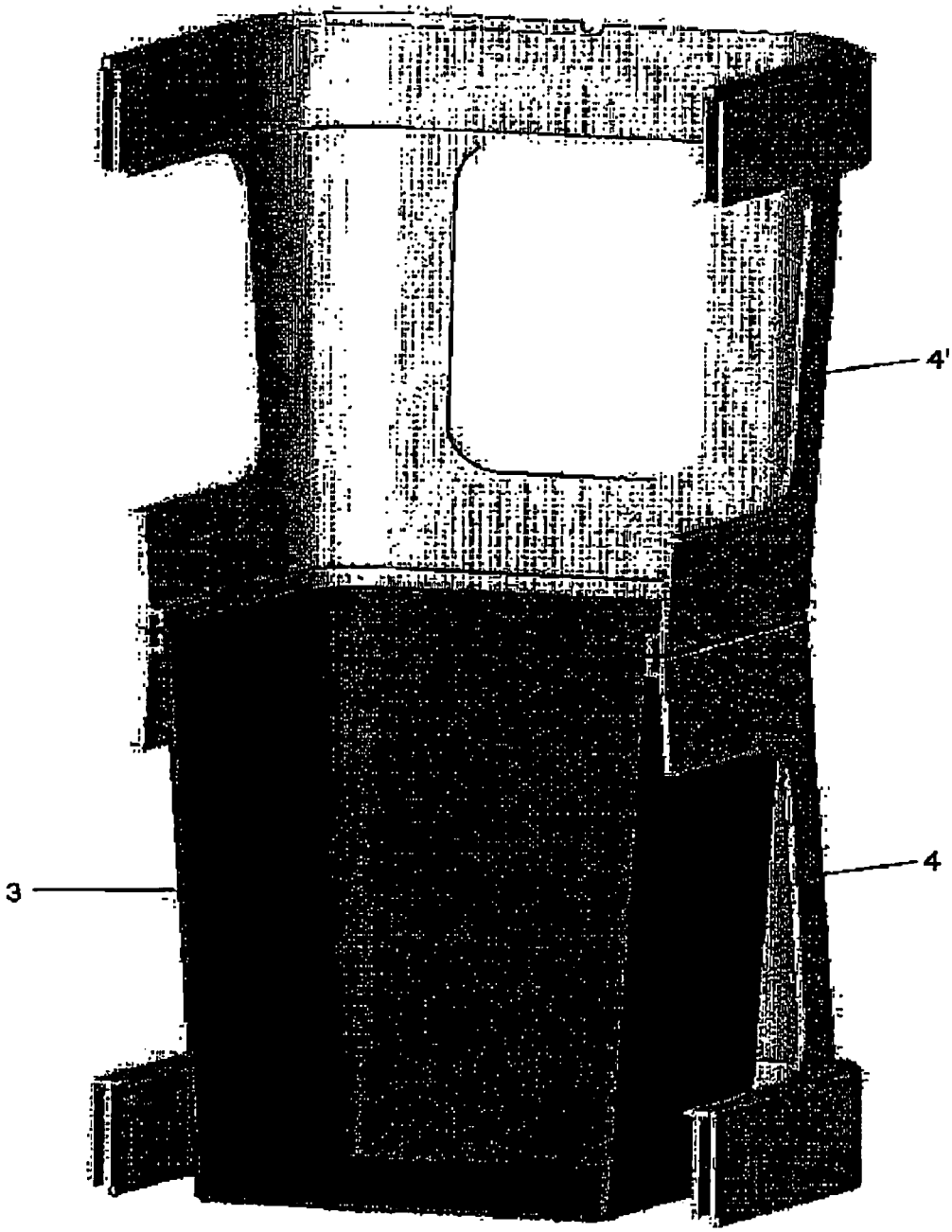
FIG. 10 shows a perspective, partly cutaway view of an assembly of an inner box and an inner box holder of the first exemplary embodiment with a second inner box holder placed thereon in inverted position.

FIG. 1 shows a so-called Danish dolly 1 on which a number of flower box assemblies 2 according to the invention are depicted. A flower box assembly according to a first exemplary embodiment comprises an inner box 3, which is represented in detail in FIGS. 4, 5, 6, and 7, and an inner box holder 4, which is represented in detail in FIGS. 2, 3, 8, and 9.

The inner box 3 of the first exemplary embodiment has a bottom wall 5 and four closed sidewalls 6, such that the inner box can be filled at least partly with water. Adjacent the upper side of the sidewalls 6, means are provided with the aid of which the inner box 3 is connectible with the inner box holder 4. These means comprise a circumferential wall 7 extending in a substantially horizontal direction, which is connected with the inner box 3 adjacent an upper edge 6*a* of the sidewalls of the inner box 3. The circumferential wall 7 is provided with at least one first projection 8. The projection 8 comprises a wall part extending throughout the circumference of the inner box, from the circumferential wall 7 in downward direction. The circumferential wall 7 is further provided with at least one second projection 9, which extends in upward direction from the circumferential wall 7 and which is situated opposite the first projection 8. This second projection 9 also extends throughout the circumference of the inner box 3. Viewed from an upper side, the sidewalls 6 of the inner boxes 3 taper slightly in the direction of the bottom wall 5, so that loose inner boxes 3 are mutually nestable.

In the first exemplary embodiment, the inner box holder 4 is provided with four sidewalls 10. Further, the inner box holder 4 has an open lower and upper side. The sidewalls of the inner box holder 4, viewed from the underside, taper slightly towards each other in the direction of the upper side, such that loose inner box holders 4 are nestable within each other. Moreover, the inner box holder 4 provides a stable basis, so that its falling over is virtually precluded. Provided in the sidewalls 10 of the inner box holder 4 are light passage openings 11. Adjacent an upper edge of the sidewalls 10 of the inner box holder 4, the sidewalls 10 are provided with a double wall 12, 13, which jointly define a recess 14. The recess 14 is so designed that the first projection 8 or the second projection 9 of the inner box 3 is receivable therein. The recess or groove 14 extends throughout the circumference of the inner box holder 4. Adjacent the lower side of the sidewalls 10, the lower edge is defined by two substantially parallel extending inner box holder sidewall parts 15, 16, more particularly an inner wall part 15 and an outer wall part 16. Over a first part A of the circumference of the inner box holder 4, the inner wall part 15 projects further down than the outer wall part 16, while over a second part B of the circumference, the outer wall part 16 projects further down than the inner wall part 15. In the first exemplary embodiment, the lower edge of the inner box holder 4 is provided with two first parts A and two second parts B which are complementary, such that, with two inner box holders 4 placed onto each other by their lower edges, the first circumference parts A of the first inner box holder 4 abut against the second circumference parts B of the second inner box holder 4'. Thus, a stable lateral locking is obtained when two inner box holders 4, 4' are stacked onto each other by their lower edges, which is shown in FIG. 1 at the top, right.

Figure 11:
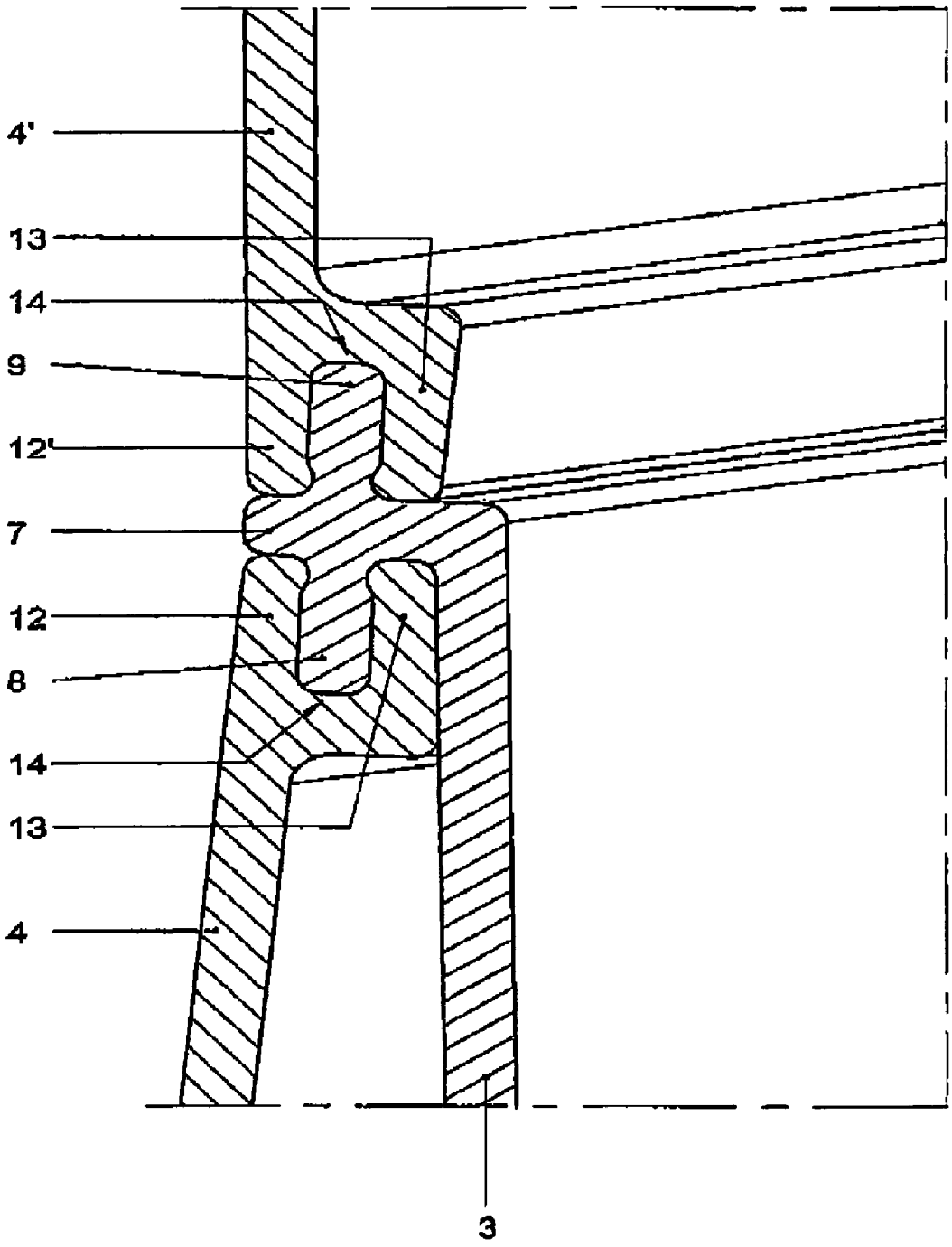
FIG. 11 shows, in cross section, in more detail, the manner in which the inner box of the first exemplary embodiment is connected with the first and the second inner box holder.

FIG. 11 shows a flower box assembly of an inner box holder 4 and an inner box 3 placed therein. Clearly visible is that the downwardly directed first projection 8 of the inner box 3 is received in the recess 14 of the inner box holder 4. Onto the assembly shown, a second inner box holder 4' has been placed, viz. in inverted position. Clearly visible is that the recess 14' of the second inner box holder 4' has received the second projection 9 of the inner box 3. All this is represented in more detail in FIG. 11. The second inner box holder 4' protects the cut flowers projecting above the upper edge of the inner box 3 from damage. Moreover, the second inner box holder 4' provides a support for a second flower box assembly, to be placed on the second inner box holder 4', which is shown in FIG. 1 at the top, right.

Summarizing, it may be stated that in the first exemplary embodiment, the inner box holder 4 and the inner box 3 are so designed that onto an assembly of an inner box holder 4 and an inner box 3, a second inner box holder 4' is placeable in inverted position. The downwardly directed upper side of the second inner box holder 4' then engages an upper side of the inner box 3. Possibly, in an alternative elaboration of the invention, the second inner box holder 4' could engage an upper side of the first inner box holder 4. Further, the inner box holder 4 is so designed that onto the second inner box holder 4' a third inner box holder 4" is placeable, with the upper side directed upwards, such that, in turn, an inner box 3" is receivable therein.

Figure 13:
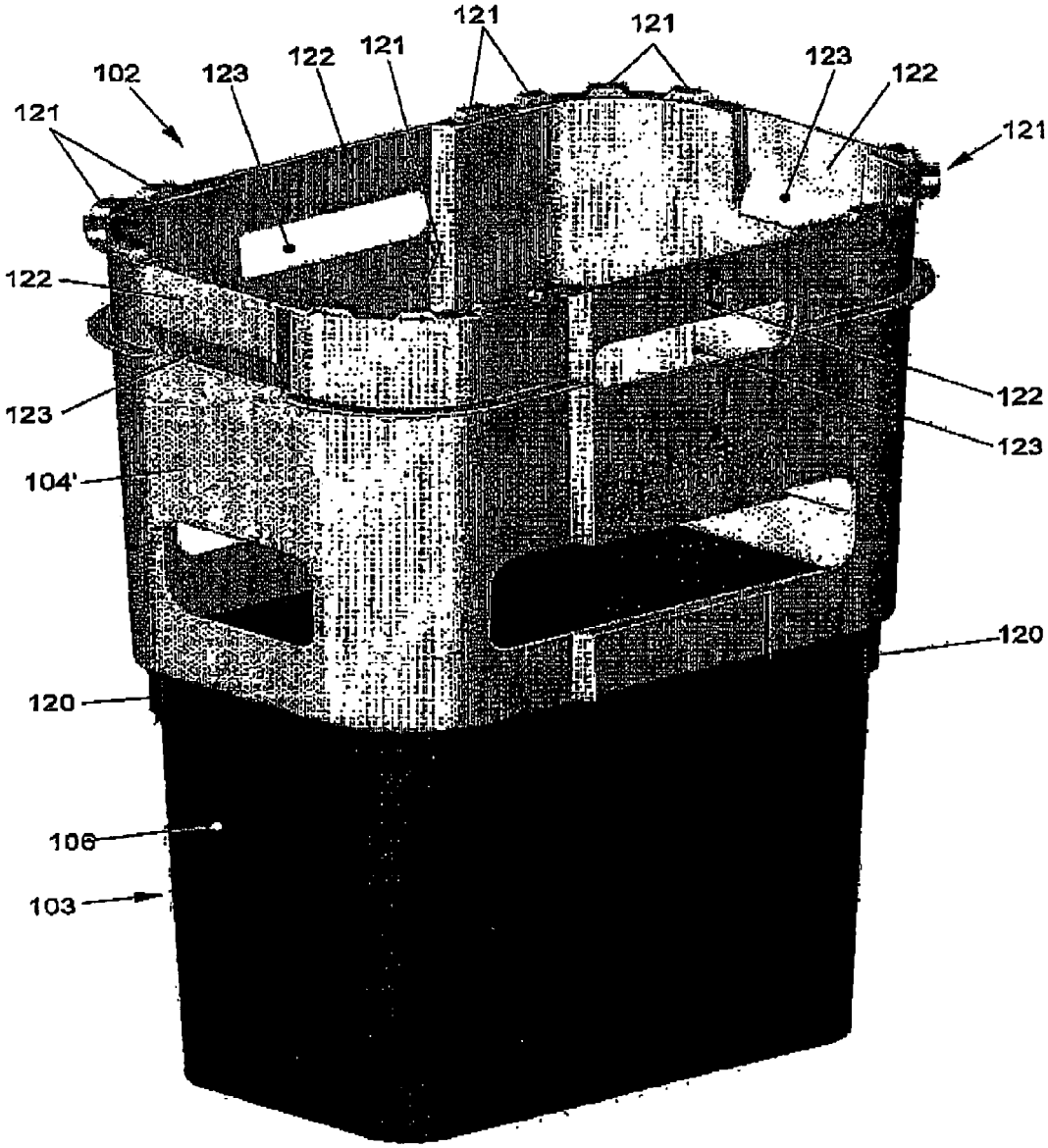
FIG. 13 shows a similar top plan view to FIG. 12, with the inner box holder in an inverted, second position.
Figure 14:
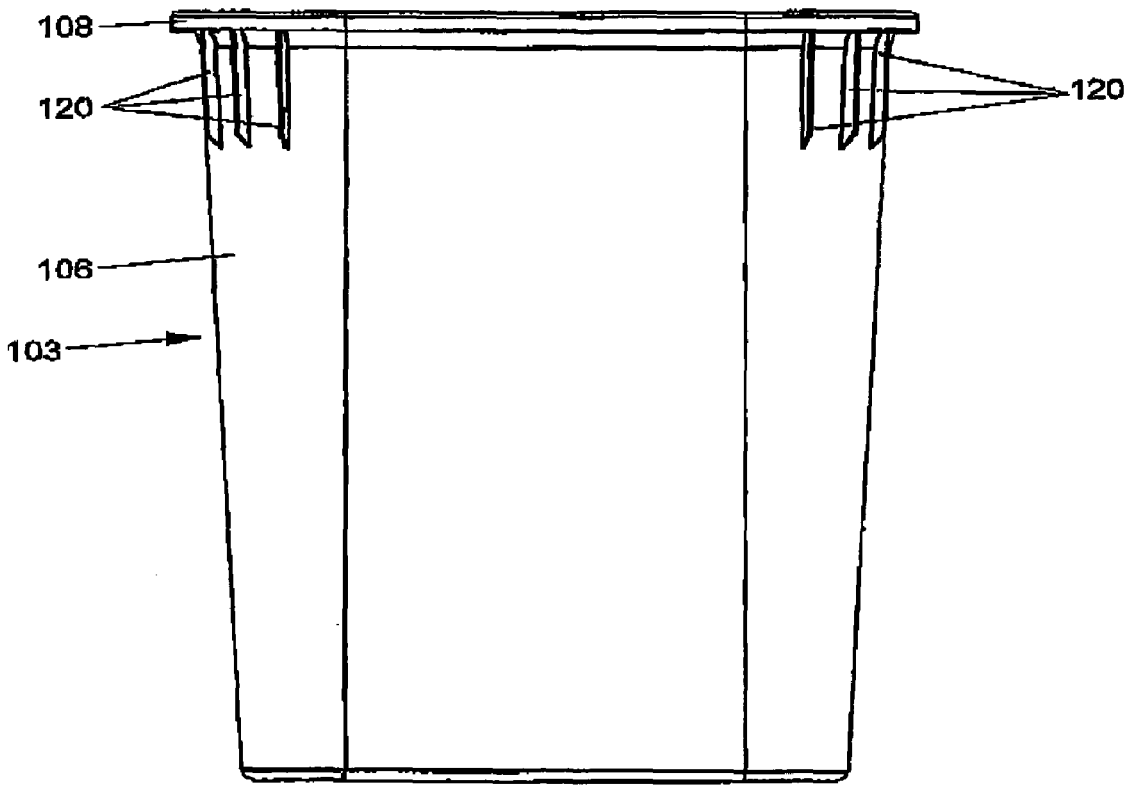
FIG. 14 shows a front view of the inner box of the exemplary embodiment represented in FIG. 12.
Figure 15:
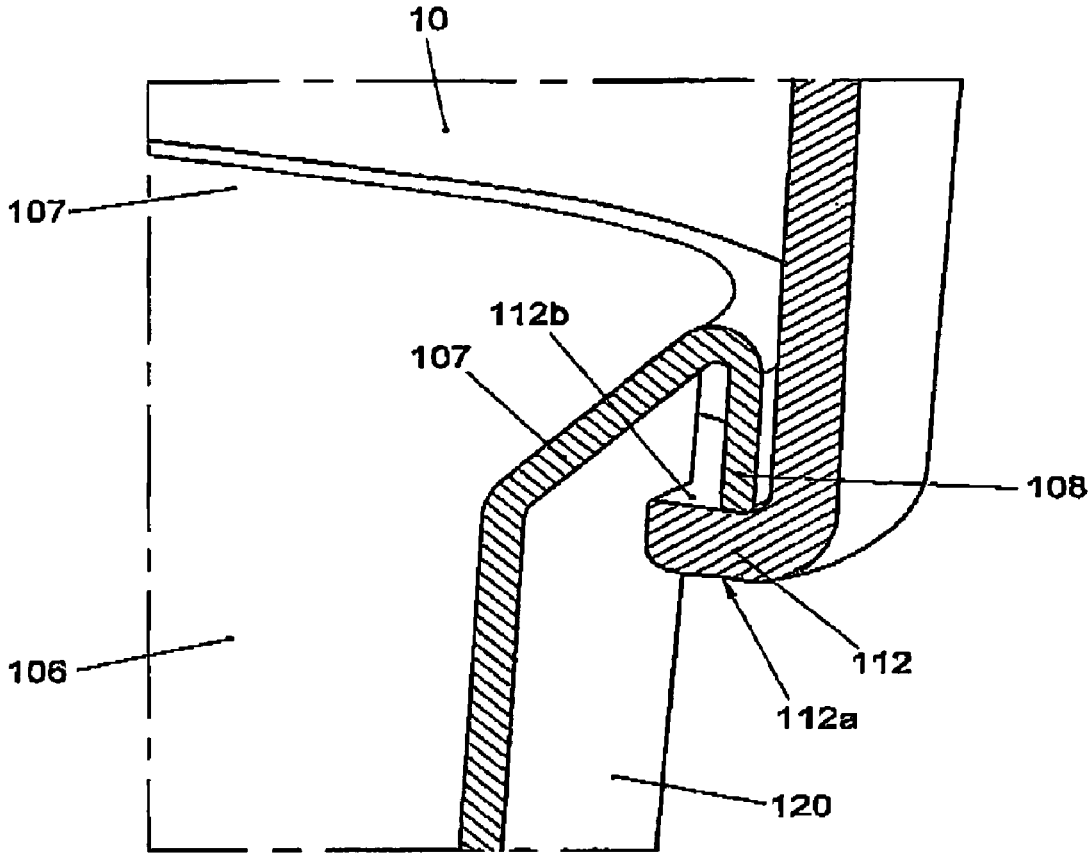
FIG. 15 shows, in cross section, in more detail, the manner in which the inner box of the exemplary embodiment represented in FIG. 13 is coupled to the inner box holder.

The second exemplary embodiment 102 represented in FIGS. 12-15 differs from the first exemplary embodiment in that the circumferential wall 107 of the upper side of the inner box 103 is provided with just one circumferential projection 108, extending in downward direction, which is clearly visible in FIG. 15. In this exemplary embodiment, the circumferential wall 107 tapers towards the circumferential projection 108. Moreover, at its upper side, the inner box holder 104 is only provided with an upper edge 112 extending inwards in horizontal direction. The lower edge of the inner box holder 104 comprises a number of toothed provisions 121 to engage an opposed complementary lower edge of another inner box holder. Two inner box holders 104 are stackable onto each other by their lower edges in a stable manner by the use of these complementary teeth 121. Such toothed provisions 121 can be designed in various ways and in different shapes. Further, the inner box holder 104 is integrally provided with handgrips 122, which are simply provided by horizontal recesses 123 extending near the lower edge of the inner box holder 104.

Figure 12:
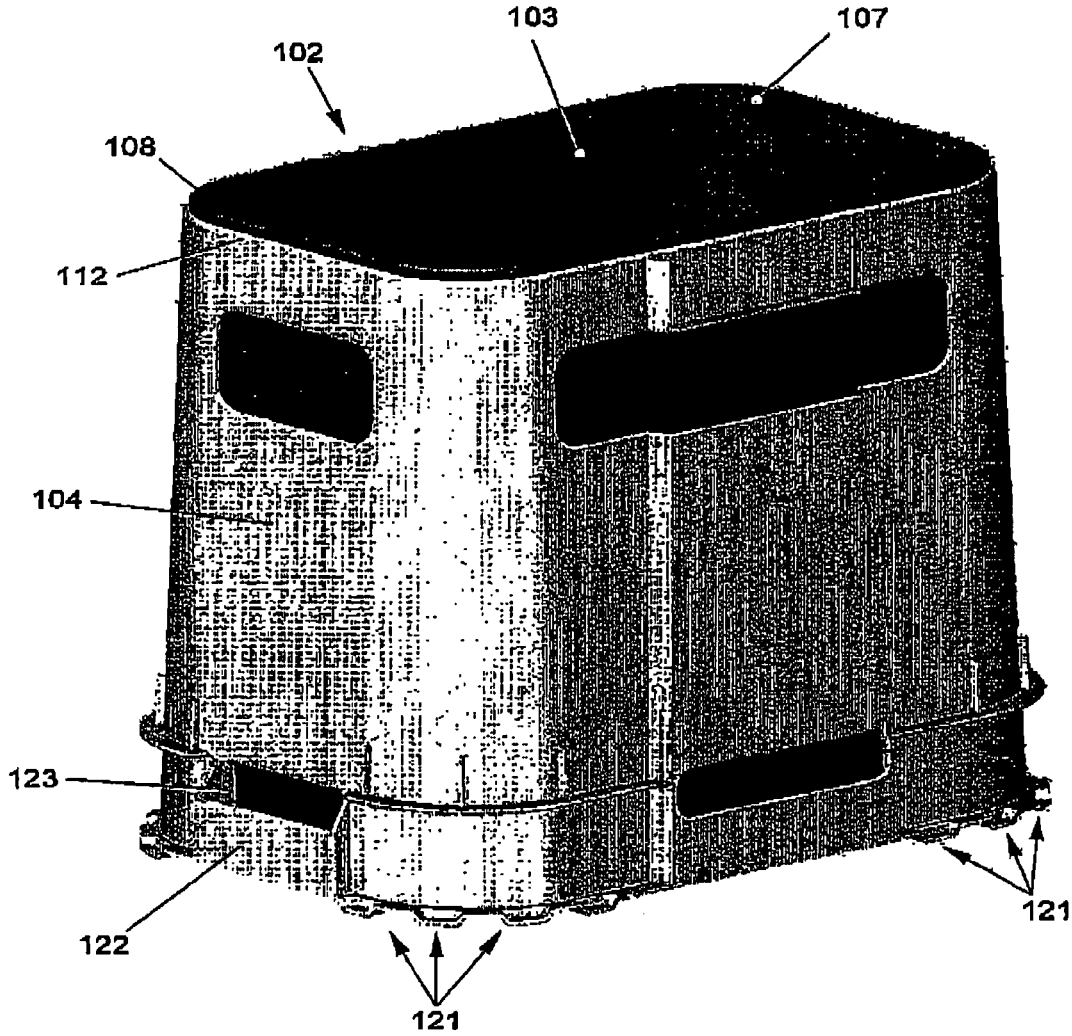
FIG. 12 shows a perspective top plan view of a second exemplary embodiment of the invention, with the inner box holder in a first position.

The inner box 103 of the second exemplary embodiment 102 is, in accordance with the position of the first exemplary embodiment as shown in FIG. 1, detachably placeable in the inner box holder 104 when the inner box holder 104 is in a first position. The first position of the inner box holder 104 of the second exemplary embodiment is represented in FIG. 12. In this position, the circumferential projection 108 of the inner box 103 engages an upper side 112*a* of the upper edge 112 of the inner box holder 164. The inner box 103 here extends substantially within the inner box holder 104.

As is clearly visible in FIGS. 13 and 15, the inner box holder 104' can further be used in an inverted second position to hold the inner box 103. In that case, the circumferential projection 108 of the inner box 103 rests on the upwardly facing underside 112*b* of the upper edge 112 of the inner box holder 104', so that the inner box 103 extends substantially under the inner box holder 104'. The inner box holder 104' can thus serve, for instance, as an aid for carrying the inner box 103 by hand, to which end the inner box holder 104' can be readily held by the handgrips 122. In addition, the inner box holder 104' in the inverted position shown in FIG. 13 can afford protection to the contents of the inner box 103 extending under it and/or constitute an extension of the sidewalls 106 of the inner box 103. The position of the assembly represented in FIG. 13 can be simply achieved by placing the inner box 103 in the inverted inner box holder 104', and subsequently pulling up the inner box holder 104' alongside the inner box 103 until the circumferential projection 108 of the inner box 103 rests on the underside 112*b* of the upper edge 112 of the inner box holder 104'.

As FIGS. 13-15 show, the inner box 103 of the second exemplary embodiment, in particular at the corners adjacent the upper side, is provided with a number of engagement means, in particular vertical clamping projections 120, to engage the inner box holder 104' in the position of the assembly 102 shown in FIG. 13. Preferably, the engagement means 120 are arranged to retain the inner box holder 104' with an engagement force that is greater than the weight of the inner box holder 104, so that the inner box holder 104' can easily preserve the position shown in FIG. 12 The engagement means mentioned can be designed in different ways and comprise, for instance, clamping means, snap means or the like. In addition1 the inner box 103 and/or the inner box holder 104 may for instance be provided with such engagement means.

It will be clear that the invention is not limited to the exemplary embodiment described, but that various modifications are possible within the framework of the invention as defined by the claims.

Figure 16:
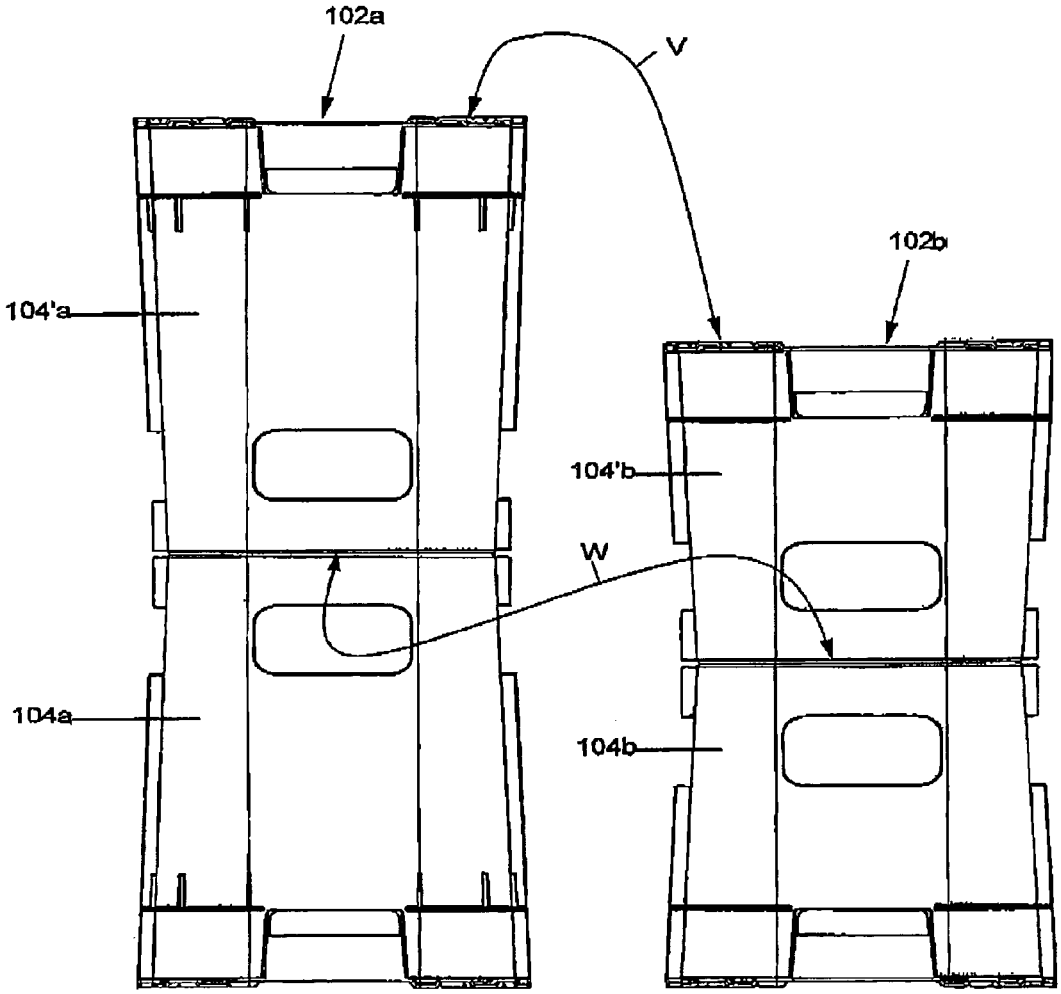
FIG. 16 shows a front view of a high and a low design of an assembly according to the invention.

Thus, the assemblies can be designed in various shapes and dimensions, for instance with different heights. FIG. 16 shows by way of example a front view of a high design 102*a* and a low design 102*b* of an assembly of an inner box and an inner box holder according to the invention. In FIG. 16, for clarity, only the inner box holders 104*a*, 104*b* of the two assemblies are represented. Preferably, the different assemblies 102*a*, 102*b* are combinable with each other. To that end, the different inner box holders 104*a*, 104*b* and/or inner boxes may for instance be provided with identical upper sides and identical lower sides. Thus, the inner box holder 104*a* of one assembly 102*a* may, for instance by an upper side, in an inverted position, be stackable onto the upper side of the inner box holder 104*b* of the other assembly 102*b*, which is indicated in FIG. 15 with arrow W. The same applies as regards placing the inner box holders 104*a*, 104*b* onto each other by way of lower sides, which is indicated with arrow V. In addition, an inner box of one assembly 102*a* may be held, for instance, in or under the inner box holder 104*b* of the other assembly 102*b*.

The invention claimed is:

1. A flower box assembly comprising:

one or more containers having a top opening, a first circumferential projection arranged along a perimeter of the top opening and defining a first region size, a first engagement portion located near the top opening, a closed bottom opposing the top opening and a plurality of closed sidewalls adjoining the bottom, the bottom and sidewalls being configured to be able to hold water; a first support frame having a hollow tube shape with at least one sidewall and a first end having a first end opening and a second end opposing the first end having a second end opening and a second engagement portion located near the first end opening; a second circumferential projection arranged along a perimeter of the first end opening and defining a second region size being smaller than the first region size such that the bottom and sidewalls of the container can pass through the first end opening and the first circumferential projection is prevented from passing through the first end opening by the second circumferential projection; and the first and second engagement portions being cooperative to form an assembled together releasable relationship between the first support frame near the first end opening and the container near the top opening, such that the container and the first support frame can be detachably assembled together in the releasable relationship.

2. A flower box assembly according to claim 1, further comprising:

a second support frame having a hollow tube shape with at least one sidewall and a first end having a first end opening and a second end opposing the first end having a second end opening and a third engagement portion located near the first end opening thereof; a third circumferential projection arranged along a perimeter of the first end opening of the second support frame and defining a third region size being smaller than the first region size such that the bottom and sidewalls of the container can pass through the first end opening of the second support frame and the first circumferential projection is prevented from passing through the first end opening of the second support frame by the third circumferential projection; the first and third engagement portions being cooperative to form an assembled together second releasable relationship between the second support frame and the container when the container and the second support frame are assembled together, such that the container and the second support frame can be detachably assembled in the second releasable relationship; the flower box assembly being arranged with the first end opening of the first support frame adjacent the first end opening of the second support frame and the first, second and third engagement portions of the container and the first and second support frames, respectively, cooperating in the first and second releasable relationships.

3. A flower box assembly according to claim 2, wherein the first support frame differs in size or shape from the second support frame.

4. A flower box assembly according to claim 3, wherein the first and second support frames each have a plurality of support walls between the respective first and second end openings that taper towards each other in the direction of the first end openings, such that the first and second support frames are configured to be nestable within each other.

5. A flower box assembly according to claim 2, wherein the first and second support frames each have a plurality of support walls between the respective first and second end openings that taper towards each other in the direction of the first end openings, such that the first and second support frames are configured to be nestable within each other.

6. A flower box assembly according to claim 2, further comprising the first circumferential projection being configured to engage an edge of the second support frame when the bottom and sidewalls of the container pass through the first end opening of the second support frame to extend substantially within the second support frame.

7. A flower box assembly according to claim 1, wherein the at least one sidewall of the first support frame tapers outward from the first end opening to the second end opening, such that the first support frame is configured to be nestable within another first support frame.

8. A flower box assembly according to claim 7, wherein:

the sidewalls of the container, viewed from the top opening, taper slightly towards each other in the direction of the bottom, such that the container is nestable within another; in the at least one sidewall of the first support frame, at least one light passage opening is included; the first circumferential projection extends at an angle at least in part in a horizontal direction adjacent an upper edge of at least one sidewall of the container, which first circumferential projection is provided with at least one first projection which engages the second circumferential projection adjacent the first end opening of the first support frame.

9. A flower box assembly according to claim 1, wherein the plurality of sidewalls of the container taper inward from the rim to the bottom, such that the container is configured to be nestable within another container.

10. A flower box assembly according to claim 1, further comprising at least one light passage opening in a sidewall of the container.

11. A flower box assembly according to claim 1, further comprising two first support frames having cooperative structures at respective second end openings such that the two first support frames when placed onto each other with abutting second end openings form a cooperative engagement for stable stacking.

12. A flower box assembly according claim 11, wherein at least one of the two first support frames is provided with at least one toothed provision to form the cooperative engagement.

13. A flower box assembly according to claim 11, wherein the respective second end openings of the two first support frames are defined by two substantially parallel extending sidewall parts, comprising an inner wall part and an outer wall part, while over a first part of the circumference of the two first support frames the inner wall part projects further down than the outer wall part, and over a second part of the circumference the outer wall part projects further down than the inner wall part.

14. A flower box assembly according to claim 13, wherein the first part and the second part of the circumference are complementary, such that, with the two first support frames placed onto each other by the respective second end openings, the first circumference part of one first support frame abuts against the second circumference part of another first support frame.

15. A flower box according to claim 14, wherein:

the first circumferential projection extends at an angle at least in part in a horizontal direction adjacent an upper edge of at least one sidewall of the container, which first circumferential projection is provided with at least one first projection which engages the second circumferential projection adjacent the first end opening of the first support frame; the projection comprises a wall part extending throughout the circumference of the container, from the first circumferential projection in a direction toward the container bottom; and the second end opening of the first support frame is designed such that two first support frames placed onto each other with abutting second end openings form a cooperative engagement for stable stacking.

the respective second end openings of the two first support frames are provided with at least one toothed provision to stack the two first support frames onto each other by the abutting respective second end openings in a stable manner; the container and the two first support frames have a substantially rectangular cross section.

16. A flower box assembly according to claim 1, wherein the container is configured to be detachably assembled with the first support frame when the first support frame is in a first relative position in relation to the container, and the container is also configured to be detachably assembled with the first support frame when the first support frame is in an inverted, second relative position in relation to the container.

17. A flower box assembly according to claim 16, wherein the bottom and sidewalls of the container pass through the one opening to extend substantially within the first support frame in the first relative position, and the bottom and sidewalls of the container extend substantially outside of the first support frame in the second relative position.

18. A flower box assembly according to claim 17, wherein: the first and second engagement portions are cooperative to form a releasably secure relationship with a particular engaging force, which engaging force is greater than a weight of the first support frame, and the flower box assembly further comprises: a second support frame having a similar shape as the first support frame with a first end having a first end opening and a second end having a second end opening and having a third engagement portion near the first end opening of the second support frame, the third engagement portion being cooperative with the first engagement portion of the container to form an assembled together second releasable relationship between the third engagement portion and the first engagement portion when the container and the second support frame are assembled in the first or second relative position, and wherein each of the first and second end openings of the first support frame respectively match the first and second end openings of the second support frame to permit the first and second support frames of different flower box assemblies to be stackable with each other in different relative orientations.

19. A flower box assembly according to claim 16, wherein the first and second engagement portions are cooperative to form the releasably secure relationship with a particular engaging force, which engaging force is greater than a weight of the first support frame.

20. A flower box assembly according to claim 1, wherein:

the first circumferential projection extends at an angle at least in part in a horizontal direction adjacent an upper edge of at least one sidewall of the container, which first circumferential projection is provided with at least one first projection which engages the second circumferential projection adjacent the first end opening of the first support frame; and the at least one first projection includes a wall part extending throughout the circumference of the container from the first circumferential projection in a downward direction.

21. A flower box assembly according to claim 1, wherein:

the first circumferential projection extends at an angle at least in part in a horizontal direction adjacent an upper edge of at least one sidewall of the container, which first circumferential projection is provided with at least one first projection which engages the second circumferential projection adjacent the first end opening of the first support frame; the projection comprises a wall part extending throughout the circumference of the container, from the first circumferential projection in a direction toward the container bottom; and the second end opening of the first support frame is designed such that two first support frames placed onto each other with abutting second end openings form a cooperative engagement for stable stacking.

22. A flower box assembly according to claim 1, wherein: the container and the first support frame are assembled with the bottom and sidewalls of the container being passed through the first end opening to extend substantially within the first support frame and the first and second engagement portions cooperate to form the assembled together releasable relationship; and the second engaging portion on the first support frame further comprising the second circumferential projection which engages the first engaging portion on the container.

23. A flower box assembly according to claim 1, further comprising:

a second support frame with a first end opening having a same size and shape as the first end opening of the first support frame, such that the first end opening of the second support frame can be placed adjacent the top opening of the container or adjacent the first end opening of the first support frame, such that the container or the first support frame supports the second support frame at the first end opening of the second support frame; and wherein the second end opening of the first support frame is shaped and sized to permit the first support frame to be placed atop and be supported by a second end opening of the second support frame opposed to the first end opening of the second support frame.

24. A flower box assembly according to claim 1, wherein the container further comprises the first circumferential projection extending at an angle at least in part in a horizontal direction, which is connected with the container adjacent an upper edge of at least one sidewall of the container, which first circumferential projection is provided with at least one first projection which engages the second engagement portion near the first end opening of the first support frame.

25. A flower box assembly according to claim 24, wherein the at least one first projection comprises a wall part extending throughout the circumference of the container, from the first circumferential projection in downward direction.

26. A flower box assembly according to claim 24, wherein the at least one first projection engages a first recess near the first end opening of the first support frame.

27. A flower box assembly according to claim 26, wherein the first recess extends throughout the circumference of the first support frame.

28. A flower box assembly according to claim 26, wherein the first circumferential projection is provided with at least a one second projection which extends in an upward direction from the first circumferential projection and which is situated opposite the at least one first projection and whose configuration is such that it is receivable in said first recess of a second support frame placed in an inverted position onto the assembly of the container and the first support frame.

29. The flowerbox assembly according to claim 1, wherein the releasably secure relationship further comprises a press fit relationship.

30. A flower box assembly comprising:

a container having a closed end, an open end and a sidewall between the closed end and open end;

a fastener component on a perimeter of the open end; and a container holder having a first open end and a second open end opposed to the first open end with a sidewall between the first open end and the second open end, the first open end having an engagement structure being cooperative with the fastener component to detachably position the container and the container holder as assembled together in a first orientation in which the closed end and sidewall of the container extend substantially within the container holder such that the sidewalls of the container and of the container holder are adjacent, the engagement structure being further cooperative with the fastener component to detachably position the container and the container holder as assembled together in a second orientation in which the closed end and sidewall of the container extend substantially outside of the container holder such that the sidewalls of the container and of the container holder are non-adjacent.

31. The flower box assembly according to claim 30, wherein the fastener component and the engagement structure cooperatively engage each other with a press fit.

* * * * *

UNITED STATES PATENT AND TRADEMARK OFFICE

CERTIFICATE OF CORRECTION

PATENT NO. : 7,536,828 B2
APPLICATION NO. : 10/806070
DATED : May 26, 2009
INVENTOR(S) : Johannes Theodorus Maria Slingerland et al.

It is certified that error appears in the above-identified patent and that said Letters Patent is hereby corrected as shown below:

Column 1, line 17, "and first" should read "and a first";

Column 2, line 40, "DRAWING" should read -- DRAWINGS -- ;

Column 4, line 63, "164" should read --104--;

Column 5, line 30, "additionall" should read --addition,--;

Column 7, claim 15, line 53, "box according" should read --box assembly according--; and Column 7, claim 15, lines 54-67, delete the entire paragraph "the first circumferential...for stable stacking.".

Signed and Sealed this

Thirtieth Day of November, 2010

David J. Kappos

David J. Kappos
*Director of the United States Patent and Trademark Office*